United States Patent [19]

George et al.

[11] Patent Number: 4,873,171

[45] Date of Patent: Oct. 10, 1989

[54] IMAGE-RECEIVING ELEMENT FOR DIFFUSION TRANSFER PHOTOGRAPHIC PRODUCT

[75] Inventors: Louis J. George, Somerville; Lloyd D. Taylor, Lexington, both of Mass.

[73] Assignee: Polaroid Corporation, Cambridge, Mass.

[21] Appl. No.: 188,897

[22] Filed: May 2, 1988

[51] Int. Cl.[4] ..... G03C 5/54

[52] U.S. Cl. ..... 430/213; 430/215

[58] Field of Search ..... 430/215, 213

[56] References Cited

U.S. PATENT DOCUMENTS

| | | | |
|---|---|---|---|
| 3,362,819 | 1/1968 | Land | 430/215 |
| 4,061,496 | 12/1977 | Hannie et al. | 430/215 |
| 4,201,587 | 5/1980 | Bedell et al. | 430/224 |
| 4,288,523 | 9/1981 | Taylor | 430/215 |
| 4,296,195 | 10/1981 | Bishop | 430/215 |
| 4,297,431 | 10/1981 | Sullivan | 430/215 |
| 4,298,674 | 11/1981 | Land et al. | 430/215 |
| 4,359,517 | 11/1982 | Bourgeois | 430/213 |
| 4,391,895 | 7/1983 | Schwarzel et al. | 430/215 |
| 4,426,481 | 1/1984 | Sullivan | 524/460 |
| 4,458,001 | 7/1984 | Taylor | 430/215 |
| 4,461,824 | 7/1984 | Mehta | 430/215 |
| 4,489,152 | 12/1984 | Oberhauser et al. | 430/229 |
| 4,547,451 | 10/1985 | Jasne et al. | 430/215 |

*Primary Examiner*—Richard L. Schilling

*Attorney, Agent, or Firm*—Louis G. Xiarhos

[57] ABSTRACT

An image-receiving element for use in photographic diffusion transfer film units of the "peel-apart" type is disclosed, comprising a support material; a polymeric acid-reacting layer; a water-permeable, water-absorbing polymeric layer for the gathering of processing moisture and image-degrading salt species; a thin, polymeric latex-deposited, water-impermeable and non-absorbing timing layer which is substantially impermeable to alkali for a predetermined period until the occurrence of a predetermined chemical reaction and conversion of said layer to a condition of permeability to alkali; and an alkali-permeable and dyeable image-receiving layer.

17 Claims, 1 Drawing Sheet

IMAGE-RECEIVING ELEMENT FOR DIFFUSION TRANSFER PHOTOGRAPHIC PRODUCT

BACKGROUND OF THE INVENTION

This invention relates to an image-receiving element for use in photographic film units of the diffusion transfer type. More particularly, it relates to an image-receiving element especially adapted to use in so-called "peel-apart" diffusion transfer film units which include an image-receiving element designed to be separated after photographic processing.

Photographic film units of the diffusion transfer type, including the aforementioned diffusion transfer "peel-apart" film units, are well known and have been described in numerous patents, including, for example, U.S. Pat. Nos. 2,983,606; 3,345,163; 3,362,819; 3,594,164; and 3,594,165. In general, diffusion transfer photographic products and processes involve film units having a photosensitive system including at least one silver halide layer, usually integrated with an image-providing material, e.g., an image dye-providing material. After photoexposure, the photosensitive system is developed, generally by uniformly distributing an aqueous alkaline processing composition over the photoexposed element, to establish an imagewise distribution of a diffusible image-providing material. The image-providing material is selectively transferred, at least in part, by diffusion to an image-receiving layer or element positioned in a superposed relationship with the developed photosensitive element and capable of mordanting or otherwise fixing the image-providing material. The image-receiving layer retains the transferred image for viewing. In diffusion transfer photographic products of the so-called "peel-apart" type, the image is viewed in the image-receiving layer upon separation of the image-receiving element from the photosensitive element after a suitable imbibition. In other products, such separation is not required.

Image-receiving elements especially adapted for use in "peel-apart" diffusion transfer film units have typically embodied a combination of particular layers on a suitable substrate material, each of the layers providing specific and desired functions adapted to the provision of the desired photographic image by diffusion transfer processing. Thus, a preferred image-receiving element has typically comprised a support material (preferably, an opaque support material carrying a light-reflecting layer for the viewing of the desired transfer image thereagainst by reflection); a polymeric acid-reacting (neutralizing) layer adapted to lower the environmental pH of the film unit subsequent to substantial transfer image formation; a spacer or timing layer adapted to slow the diffusion of the alkali of an aqueous alkaline processing composition toward the polymeric neutralizing layer; and an image-receiving layer to receive the transferred photographic image. Such preferred structure is described, for example, in the aforementioned U.S. Pat. No. 3,362,819 and is illustrated in other patents, including U.S. Pat. Nos. 4,322,489 and 4,547,451.

Various materials have been described as being suited to application as a spacer or timing layer positioned between the polymeric acid-reacting layer and the image-receiving layer of an image-receiving element of the aforedescribed type. Thus, in the aforementioned U.S. Pat. No. 4,322,489, reference is made to the use of polyvinyl alcohol, gelatin or other polymers through which alkali may diffuse to the polymeric acid-reacting layer. The presence of such a timing layer between the image-receiving layer and the acid-reacting layer effectively controls the initiation and the rate of capture of alkali by the acid-reacting layer. Other materials suitable for the formation of timing layers and the advantages thereof in diffusion transfer systems are described with particularity in U.S. Pat. Nos. 3,362,819; 3,419,389; 3,421,893; 3,455,686; 3,577,237; and 3,575,701.

It has been disclosed that advantages in diffusion transfer processing can be realized by employing as a timing layer a polymeric material which functions as an alkali-impermeable barrier for a predetermined time interval and which then converts to a relatively alkali-permeable condition upon occurrence of a predetermined chemical reaction in the timing layer to allow access of the alkali to the neutralization layer in a rapid and quantitatively substantial fashion. The capacity of the timing layer to prevent passage or diffusion of alkali therethrough for a predetermined length of time during the processing of the film unit, and the capacity of the layer to convert over a short time period to a condition of substantial permeability to alkali, allows the layer to serve as an effective diffusion control layer. The timing layer thus acts as a "hold-release" layer, in that, alkali subject to diffusion control by the timing layer is "held" in place for a predetermined period of time and then "released" in substantial quantity over a relatively short time period, i.e., allowed to rapidly diffuse through the layer. This desirable "hold-release" behavior may be contrasted with the behavior of timing layers which do not undergo a precipitous change in permeability but, rather, are initially permeable to alkali to some degree and which, thus, allow a slow leakage of alkali from the start of processing, gradually becoming more permeable during the processing interval.

The chemical reaction mechanism utilized in the production of a timing layer exhibiting desired "hold-release" behavior can be a beta-elimination reaction which is activated by the alkali of the alkaline processing composition. Examples of polymeric materials which undergo an alkali-initiated beta-elimination reaction, and which can be used as timing layers of the "hold-release" type are known and are described in U.S. Pat. Nos. 4,201,587; 4,297,431; 4,391,895; 4,426,481; 4,458,001 and 4,461,824. Timing layers which are converted from a condition of impermeability to alkali to a condition of substantial permeability thereto as a function of a predetermined hydrolysis reaction, are also useful and are described in U.S. Pat. No. 4,547,451.

The use of timing layers of the aforedescribed "hold-release" type provides advantages in color saturation, notably by preventing premature reduction of environmental pH in the film unit during processing and by allowing substantial dye-image transfer to occur at elevated pH before a substantial and predetermined pH reduction. These benefits are, in general, obtained by employing a timing layer of the aforedescribed character which typically will be a relatively water-impermeable layer which is non-sorptive of water and which is coated as a thin layer of a thickness adapted to the particular timing requirement of a photographic system. Such a layer will, in general, be provided conveniently by coating a latex of polymeric material having the predetermied diffusion control properties. While substantial benefits are realized by utilizing timing layers of the aforedescribed type, deficiencies have, nonetheless been observed.

For example, there has been observed a tendency for the image-bearing layer to be incompletely adhered to the timing layer, such that, the application of slight pressure to the photograph freshly separated from the photosensitive element, causes a shifting or smearing of the layer, thus, producing image distortion. In addition, salt materials have been detected in the image-bearing layer. These salt materials contribute to haze and prevent the realization of desirable maximum dye densities.

SUMMARY OF THE INVENTION

It has been found that image quality and adhesion of a dye image-bearing layer to a timing layer of the aforedescribed type (i.e., a timing layer which functions as a barrier layer to alkali until the occurrence of a predetermined chemical reaction and conversion over a relatively short time period to a condition of substantial permeability thereto) can be substantially improved by including in the image-receiving element, as an additional layer positioned between the polymeric acid-reacting layer and such timing layer, a polymeric, water-permeable, water-absorbing layer. The presence of such additional layer in the image-receiving element enables the production (by diffusion transfer processing of photographic film units of the "peel-apart" type) of photographs which have a dye image-bearing layer which is securely adhered to the timing layer and which is substantially free of salt species which tend to degrade image quality.

According to the present invention, there is provided an image-receiving element which comprises a support material; a polymeric acid-reacting layer; a water-permeable, water-absorbing polymeric layer; a thin, water-impermeable, non-absorbing polymeric timing layer deposited from a polymeric latex and being substantially impermeable to alkali for a predetermined period until the occurrence of a predetermined chemical reaction and conversion of said layer to a condition of permeability to alkali; and an alkali-permeable and dyeable image-receiving layer.

The present invention will be more readily understood by the following detailed description taken in conjunction with the accompanying drawings.

THE DRAWINGS

DETAILED DESCRIPTION

As mentioned hereinbefore, the presence of a water-permeable, water-absorbing polymeric layer in the image-receiving element of the invention permits the production of diffusion transfer photographs of improved quality, owing to the tendency of the image-bearing layer to be securely adhered to the timing layer and the tendency of image-degrading salt species to be relatively absent from the image-receiving layer. While applicants do not wish to be bound by any particular theory or mechanism in explanation of the desirable improvement realized by the addition to an image-receiving element of a water-permeable, water-absorbing polymeric layer, it is believed that such advantages are attributable to the capacity of such layer to absorb water and, thus, function as a repository for excess water or moisture in the image-receiving element. The water-absorbing polymeric layer is believed to gather water, which if present between the image-bearing layer and the non-absorbing timing layer, would prevent secure bonding between said layers and cause incomplete drying of the image-receiving layer. In addition, it is believed that the water-absorbing layer retains salt species which are produced during photographic processing and which otherwise may migrate to the image-bearing layer and degrade the quality of the photographic image.

Figure 1:
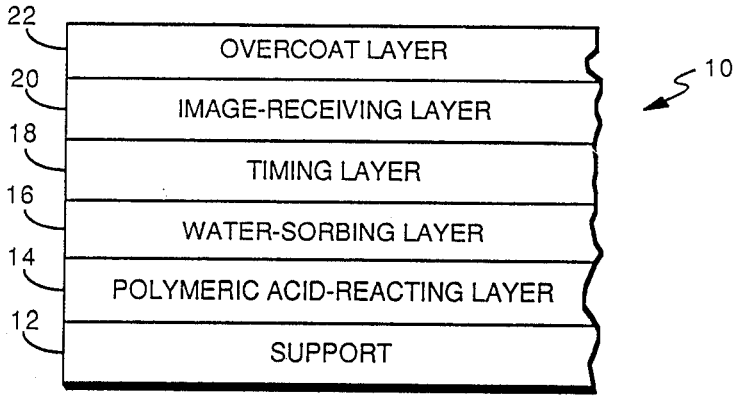
FIG. 1 is a cross-sectional view of an image-receiving element including a water-permeable water sorbing polymeric layer.

Referring to FIG. 1, there is shown an image-receiving element 10 of the invention comprising support material 12 carrying a polymeric acid-reacting layer 14, a water-permeable, water-absorbing layer 16, a timing (or spacer) layer 18, an image-receiving layer 20, and an optional overcoat layer 22. Each of the layers carried by support 12 functions in a predetermined manner to provide desired diffusion transfer processing and is described in greater detail hereinafter.

Support material 12 can comprise any of a variety of materials capable of carrying layers 14, 16, 18, 20 and 22, as shown in FIG. 1. Paper, vinyl chloride polymers, polyamides such as nylon, polyesters such as polyethylene terephthalate, or cellulosic derivatives such as cellulose acetate or cellulose acetate-butyrate, can be suitably employed. Depending upon the desired nature of the finished photograph, the nature of support material 12 as a transparent, opaque or translucent material will be a matter of choice. Typically, an image-receiving element of the present invention, adapted to be used in so-called "peel-apart" diffusion transfer film units and designed to be separated after processing, will be based upon an opaque support material 12. As illustrated in the film unit of FIG. 2, (which shows the film unit after photographic processing and prior to the separation of image-receiving element 10*a* from the processed photosensitive element 30*b*), support 12 can comprise an opaque support material 12*a*, such as paper, carrying a light-reflecting layer 12*b*. On separation of the image-bearing photograph 10*a*, the image in layer 20*a* can be viewed against light-reflecting layer 12*b*. Light-reflecting layer 12*b* can comprise, for example, a polymeric matrix containing a suitable white pigment material, e.g., titanium dioxide.

While support material 12 of image-receiving element 10 will preferably be an opaque material for production of a photographic reflection print, it will be appreciated that support 12 will be a transparent support material where the processing of a photographic transparency is desired. In the event that support material 12 is a transparent sheet material, an opaque sheet (not shown), preferably pressure-sensitive, can be applied over the transparent support to permit in-light development. Upon processing and removal of the opaque pressure-sensitive sheet, the photographic image diffused into image-receiving layer 20 can be viewed as a transparency.

Figure 2:
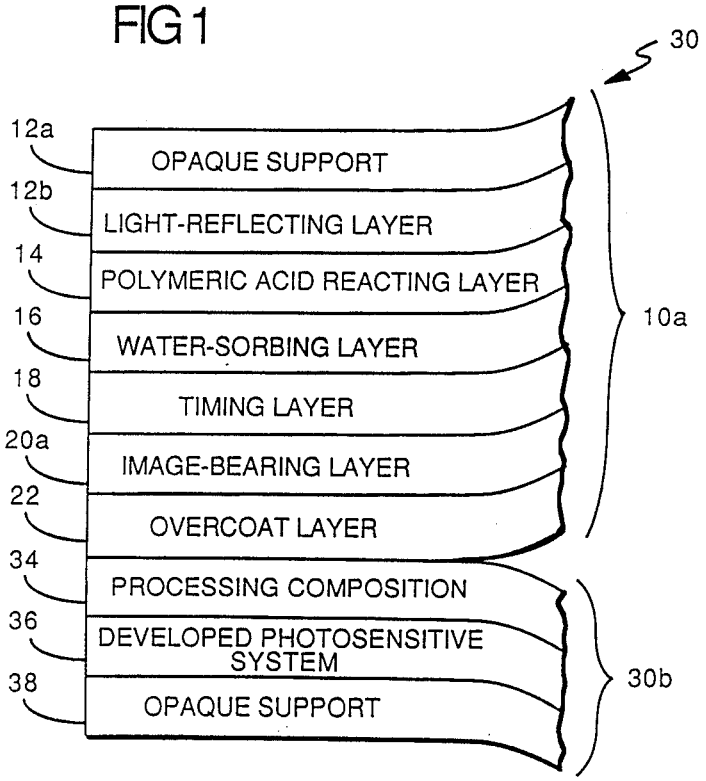
FIG. 2 is a cross-sectional schematic view of a photographic film unit embodying an image-receiving element of the present invention, shown after exposure and processing.

As illustrated in each of FIGS. 1 and 2, image-receiving element 10 includes a polymeric acid-reacting layer. Polymeric acid-reacting layer 14 serves an important function in reducing the environmental pH of the film unit, subsequent to transfer image formation, to a pH at which the residual dye developers remaining within the negative structure are precipitated or otherwise rendered non-diffusible in either their reduced or oxidized state. As disclosed, for example, in the previously referenced U.S. Pat. No. 3,362,819, the polymeric acid-reacting layer may comprise a nondiffusible acid-reacting reagent adapted to lower the pH from the first (high) pH of the processing composition in which the image dyes are diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and layer 14 which comprises immobilized acid-reactive sites and which functions as a neutralization layer. Preferred polymers for neutralization layer 14 comprise such polymeric acids as cellulose acetate hydrogen phthalate; polyvinyl hydrogen phthalate; polyacrylic acid; polystyrene sulfonic acid; and partial esters of polyethylene/maleic anhydride copolymers.

Polymeric acid-reacting layer 14 can be applied, if desired, by coating support material 12 with an organic solvent-based or water-based coating composition. A preferred polymeric acid-reacting layer which is typically coated as an organic-based composition comprises a mixture of a half butyl ester of polyethylene/maleic anhydride copolymer with polyvinyl butyral. A suitable water-based composition for the provision of polymeric acid-reacting layer 14 comprises a mixture of a water-soluble polymeric acid and a water-soluble matrix or binder material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819 and 3,756,815, mentioned may be made of those disclosed in the following U.S. Pat. Nos.: 3,765,885; 3,819,371; 3,833,367 and 3,754,910.

Water-absorbing layer 16 provides an important function in the image-receiving element of the present invention in acting as a repository for water introduced into the image-receiving element as a function of conventional diffusion transfer processing using an aqueous alkaline processing composition. As is well known in diffusion transfer processing, image-receiving element 10 is brought into a superposed relation with a photoexposed photosensitive element and a photographic processing composition 34 is uniformly distributed between the photosensitive and image-receiving elements. A preferred means for distributing processing composition 34 between such elements comprises passing the respective elements between a pair of rollers to rupture a rupturable pod (not shown) and to thereby uniformly distribute the processing composition contained therein as a layer of processing composition 34. After a suitable imbibition period and desired image formation, the photosensitive and image-receiving elements are separated as element **30*b* and 10*a*, respectively, as shown in FIG. 2. It has been found that, but for the presence of water-absorbing layer 16, water introduced into image-bearing layer 20*a* of photograph 10*a* would tend to promote inadequate adhesion of image-bearing layer 20*a* to timing layer 18. The presence of water-absorbing layer 16, however, serves as a repository for moisture and allows image-bearing layer 20*a* to dry more rapidly and to be more firmly adhered to timing layer 18**.

Suitable water-absorbing materials useful for layer 16 include water-permeable polymeric materials such as hardened gelatin, polyvinyl alcohol, hydroxyethyl cellulose, polyacrylamide, hydroxypropyl cellulose and mixtures thereof. The thickness of layer 16 is not critical. It should be coated, however, at a thickness suitable to the functioning of layer 16 as a repository for water introduced into image-bearing element **10*a* as a function of the processing composition 34, and especially, the thickness of processing composition layer 34, which can vary depending upon the particular nature of the photosensitive element employed and the desired sensitometry of the photographic system. Preferred water-permeable polymeric materials suited to formation of water-absorbing layer 16** include hardened gelatin, hydroxypropyl cellulose, polyacrylamide and mixtures thereof. As mentioned previously, other polymeric materials can be employed.

Timing layer 18 controls the initiation and the rate of capture of alkali by the acid-reacting polymer layer 14. As indicated previously, timing layer 18 serves as an alkali impermeable barrier for a predetermined time interval before converting in a rapid and quatitatively substantial fashion to a relatively alkali permeable condition, upon the occurrence of a predetermined chemical reaction. Timing layer 18 can be provided by resort to polymeric materials which are known in the diffusion transfer art and which are described, for example, in U.S. Pat. Nos. 4,201,587; 4,288,523; 4,297,431; 4,391,895; 4,426,481; 4,458,001; 4,461,824 and 4,547,451. As described in these patents, timing layers having the aforedescribed characteristics can be prepared from polymers which comprise repeating units derived from polymerizable monomeric compounds containing groups which undergo a predetermined chemical reaction as a function of contact with alkali and which are then rendered permeable to alkali. Monomeric compounds which are capable of undergoing a beta-elimination or which undergo an hydrolytic degradation after a predetermined period of impermeability to alkali can be employed in the production of suitable polymeric timing layer materials.

Among preferred polymeric materials for the formation of timing layer 18 are polymers which comprise repeating units of the formula

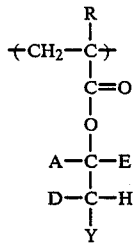

(I)

wherein R is hydrogen or lower alkyl; A, D, and E are selected from the group consisting of hydrogen, methyl and phenyl, provided that no more than one of A, D, or E may be methyl or phenyl; and Y is an activating group for a beta-elimination reaction. Polymers containing the formula (I) repeating units are described in the aforementioned U.S. Pat. No. 4,297,431. As described in such patent, the presence of a beta-elimination activating group Y and the presence of an abstractable proton permit the occurrence after a predetermined "hold" interval of an alkali- initiated, betaelimination reaction and a change in the condition of the timing layer to one of permeability to alkali.

If desired, the conversion of timing layer 18 from a condition of alkali impermeability to a condition of permeability thereto can be the result of an alkaliinitiated hydrolysis reaction which occurs after a predetermined "hold" time interval. Examples of polymers of this type are those which include repeating units of formulas (II) and/or (III) as follows, where R is hydrogen or lower alkyl (e.g., methyl); A and D are each hydrogen, methyl or phenyl; and $R^2$ is alkyl:

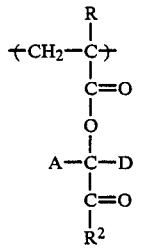

(II)

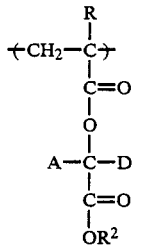

(III)

Preferably, each of A and D is hydrogen, although in the case of repeating units of the type represented by Formula (II), it will be preferred that each of A and D be methyl. Preferably, $R^2$ represents methyl or ethyl.

Polymeric materials suitable for the production of timing layer 18 will typically be copolymers comprising repeating units of the aforedescribed type (i.e., repeating units derived from polymerizable monomers capable of undergoing an alkaliinitiated chemical reaction after a predetermined "hold" time interval) and comonomeric units incorporated into the polymer to impart thereto predetermined properties. For example, the "hold time", i.e., the time interval during which timing layer 18 remains impermeable to alkali during processing, can be affected by the relative hydrophilicity of the layer resulting from incorporation of a given comonomer or mixture of comonomers into the timing layer polymer. In general, the more hydrophobic the polymer, the slower will be the rate of permeation of alkali into the timing layer to initiate the alkali-activated chemical reaction, i.e., the longer the alkali hold time. Alternatively, adjustment of the hydrophobic/hydrophilic balance of the polymer by inclusion of appropriate comonomeric units may be used to impart predetermined permeability characteristics to a timing layer as appropriate for a given usage within a film unit.

The predetermined hold time of timing layer 18 can be adjusted as appropriate for a given photographic process by means such as controlling the molar ratio or proportion of repeating units which undergo the desired alkali-initiated chemical reaction; altering the thickness of the timing layer; incorporation of appropriate comonomeric units into the polymer to impart thereto a desired hydrophobic/hydrophilic balance or degree of coalescence; using different activating groups to affect the initiation and rate of the alkali-initiated chemical reaction; or utilizing other materials, particularly polymeric materials, in the timing layer to modulate the permeation of alkali into timing layer 18, thereby altering the time necessary for initiation of the desired and predetermined chemical reaction. This latter means of adjusting the hold time of timing layer 18 may include, for example, utilization of a matrix polymer material having a predetermined permeability to alkali or aqueous alkaline processing composition as determined, for example, by the hydrophobic/hydrophilic balance or degree of coalescence thereof.

In general, increased permeability to alkali or aqueous alkaline processing composition, and thus, a shorter hold time, may be obtained by increasing the hydrophilicity of the matrix polymer or decreasing the degree of coalescence. Alternatively, decreased permeability of alkali or aqueous alkaline processing composition into timing layer 18 and, thus, a longer hold time, may be obtained by increasing the hydrophobicity of the matrix polymer or increasing the degree of coalescence.

Examples of suitable comonomers which can be used in the production of copolymeric materials suited to application in timing layer 18 include acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl)acrylamide; N-isopropyl acrylamide; N-(β-hydroxy ethyl)acrylamide, N-(β-dimethylaminoethyl)acrylamide; N-(t-butyl)acrylamide; N-(β-(dimethylamino)ethyl]methacrylamide; 2-[2'-(acrylamido)ethoxy]ethanol; N-(3'-methoxy propyl)acrylamide; 2-acrylamido-3-methol butyramide; acrylamido acetamide; methacrylamido acetamide; 2-[2-methacrylamido-3'-methyl butyramido]acetamide; and diacetone acrylamide.

Matrix polymer systems adapted to utilization in timing layer 18 can be prepared by physical mixing of the matrix polymer and the polymer containing the repeating units capable of undergoing alkali-initiated chemical reaction, or by the preparation of the timing layer polymer in the presence of a preformed matrix polymer. Polymers which may be used as matrix polymers will generally be copolymers which comprise comonomer units such as acrylic acid; methacrylic acid; methyl methacrylate; 2-acrylamido-2-methylpropane sulfonic acid; acrylamide; methacrylamide; N,N-dimethyl acrylamide; ethyl acrylate; butyl acrylate; diacetone acrylamide; acrylamido acetamide; methacrylamido acetamide.

In the production of copolymeric timing layer materials, and in the production of matrix polymers, the comonomeric units, as well as the ratios thereof, should be chosen on the basis of the physical characteristics desired in the matrix polymer and in the timing layer in which it is to be utilized.

Reference has been made to the utilization (in timing layers containing polymers capable of undergoing alkali- initiated chemical reaction) of other materials, particularly polymeric materials, to adjust the hold time of the timing layer in a predetermined manner and as appropriate for a given photographic process. It will be understood, however, that the presence in timing layer 18 of polymer or other materials which adversely affect or negate the desired alkali impermeable barrier properties of timing layer 18 is to be avoided. In this connection, it should be noted the gelatin, and particularly unhardened gelatin, is readily swollen and permeated by aqueous alkaline compositions typically employed in photographic processing. Accordingly, the presence in a timing layer of the invention of amounts of gelatin or other materials which promote rapid permeation of the layer by alkali and which effectively negate the hold character of the layer, are to be avoided.

Timing layer 18 is typically applied as a water-impermeable layer which results from the coalescence and the drying of a coating composition, e.g., a latex composition. Typically the timing layer will be coated at a coverage of about 200 mg/m$^2$ to about 800 mg/m$^2$ and comprises essentially a thin and water-impermeable layer. It is believed, as a consequence, that the non-absorbing character of timing layer 18 prevents absorption of excess water or moisture (introduced by the processing composition) resulting in excess water or moisture in the image-bearing layer and poor adhesion thereof to the timing layer. The presence of the water-absorbing layer 16 serves, however, to hold moisture or water and thus permit an effective adhesion between image-bearing layer 20*a* and timing layer 18. In addition, water which becomes absorbed by water-absorbing layer 16 contains salts, e.g., potassium bromide, formed during photographic processing and which otherwise may deposit in image-bearing layer 20*a* to contribute to poor image quality.

The image-receiving layer 20 generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061 to Howard C. Haas. A preferred image-receiving layer material comprises a graft copolymer of 4-vinyl pyridine, vinylbenzyltrimethylammonium chloride grafted onto hydroxyethyl cellulose. Such graft copolymers and their use as image-receiving layers are further described in U.S. Pat. Nos. 3,756,814 and 4,080,346 issued to Stanley F. Bedell. Other materials can, however, be employed. Suitable mordant materials of the vinylbenzyltrialkylammonium type are described, for example, in U.S. Pat. No. 3,770,439, issued to Lloyd D. Taylor. Mordant polymers of the hydrazinium type (such as polymeric mordants prepared by quaternization of polyvinylbenzyl chloride with a disubstituted asymmetric hydrazine) can be employed. Such mordants are described in Great Britain Pat. No. 1,022,207, published Mar. 9, 1966. A preferred hydrazinium mordant is poly (1-vinylbenzyl 1,1-dimethylhydrazinium chloride) which, for example, can be admixed with polyvinyl alcohol for provision of a suitable image-receiving layer.

In FIG. 1 is shown overcoat layer 22 which comprises an optional layer of image-receiving element 10. Image-receiving layer 20 can, thus, comprise the outermost layer of image-receiving element 10. In some instances, it may be desirable to provide such image-receiving layer 20 with only a washing treatment, as by washing the layer with ammonia. The washing treatment can be conveniently effected with ammonia or a solution of ammonium hydroxide in a concentration, preferably of from about 2% to about 8% by weight. Such ammonia washing treatment effectively neutralizes residual acrolein/formaldehyde condensate where such a material is utilized for the hardening of the image-receiving layer and the provision of reduced water sensitivity.

According to the embodiment shown in FIG. 1, a separate overcoat layer 22 is present on image-receiving layer 20. Overcoat layer 22 can be used as a means of facilitating separation of image-receiving element 10 from a photosensitive element. Thus, in photographic film unit 30 which is processed by distribution of an aqueous alkaline processing composition between the image-receiving element and a photoexposed photosensitive element, overcoat layer 22 functions as a "strip coat" to facilate separation of the finished photograph 10*a* from the developed photosensitive element and processing composition layer (collectively, 30*b*).

An overcoat suited as a "strip coat" can be prepared from a variety of hydrophilic colloid materials. Preferred hydrophilic colloids for an overcoat or "strip coat" include gum arabic, carboxymethyl cellulose, hydroxyethyl cellulose, carboxymethyl hydroxyethyl cellulose, cellulose acetatehydrogen phthalate, polyvinyl alcohol, polyvinyl pyrrolidone, methyl cellulose, ethyl cellulose, cellulose nitrate, sodium alginate, pectin, polymethacrylic acid, polymerized salts or alkyl, aryl and alkyl sulfonic acids (e.g., Daxad, W. R. Grace Co.), polyoxyethylene polyoxypropylene block copolymers (e.g., Pluronic F-127, BASF Wyandotte Corp.) or the like.

Overcoat 22 can comprise a solution of hydrophilic colloid and ammonia and can be coated from an aqueous coating solution prepared by diluting concentrated ammonium hydroxide (about 28.7%) $NH_3$) with water to the desired concentration, preferably from about 2% to about 8% by weight, and then adding to this solution an aqueous hydrophilic colloid solution having a total solids concentration in the range of about 1% to about 5% by weight. The coating solution also preferably may include a small amount of a surfactant, for example, less than about 0.10% by weight of Triton X-100 (Rohm and Haas, Co., Phila., Pa.). A preferred solution comprises about 3 parts by weight of ammonium hydroxide and about 2 parts by weight of gum arabic.

The image-receiving elements of the present invention are especially adapted to utilization in film units intended to provide multicolor dye images. The image-receiving elements can be processed with a photosensitive element and a processing composition as illustrated in FIG. 2. The most commonly employed negative components for forming multicolor images are of the "tripack" structure and contain blue-, green-, and red-sensitive silver halide layers each having associated therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163 (issued Oct. 3, 1967 to E. H. Land, et al.); in U.S. Pat. No. 2,983,606 (issued May 9, 1961 to H. G. Rogers); and in U.S. Pat. No. 4,322,489 (issued Mar. 30, 1982 to E. H. Land, et al.). Photosensitive elements which include dye developers and a dye-providing thiazolidine compound can be used with good results and are described in the pending U.S. patent application of P. O. Kliem, Ser. No. 846,586, filed Mar. 31, 1986.

The following examples are illustrative of the present invention and it will be understood that the invention is not limited thereto. All parts and percentages are by weight, except as otherwise indicated.

EXAMPLE 1

An image-receiving element comprising the following layers in succession on a white-pigmented polyethylene-coated paper (opaque) support was prepared, the layers comprising:

1. a polymeric acid-reacting layer, at a coverage of about 2000 mgs/ft$^2$ (21528 mgs/m$^2$), comprising a mixture of about nine parts of a half butyl ester of polyethylene/maleic anhydride copolymer and about one part of polyvinyl butyral;

2. a layer, at a coverage of about 300 mgs/ft$^2$ (3229 mgs/m$^2$), of gelatin and about 24 mgs/ft$^2$ (258 mgs/m$^2$) of succindialdehyde hardening agent;

3. a timing layer, at a coverage of about 200 mgs/ft$^2$ (2153 mgs/m$^2$), coated from a latex and comprising a 50/30/6/10/4 copolymer of diacetone acrylamide/butyl acrylate/methyl methacrylate/carbomethoxymethyl acrylate/methacrylic acid;

4. an image-receiving layer, at a coverage of about 440 mgs/ft$^2$ (4736 mgs/m$^2$) of a mixture comprising a 2:1 mixture of polyvinyl alcohol and poly(1-vinylbenzyl 1,1-dimethylhydrazinium chloride) and about 1 mg/ft$^2$ (10.8 mgs/m$^2$) of acrolein/formaldehyde condensate hardening agent; and 5. an overcoat layer, at a coverage of about 25 mgs/ft$^2$ (269 mgs/m$^2$) of polyoxyethylene polyoxypropylene block copolymer having an average molecular weight of about 12,500 (Pluronic F-127 from BASF Wyandotte Corp.).

The image-receiving element is identified herein as Image-Receiving Element A.

EXAMPLE 2

As a means of establishing a basis for comparative evaluation of Image-Receiving Element A (EXAMPLE 1), a control image-receiving element (identified as Image-Receiving Element A-Control) was prepared. Image-Receiving Element A-Control was prepared in the same manner as Image-Receiving Element A, except that, layer #2 thereof was omitted.

EXAMPLE 3

The image-receiving elements of EXAMPLES 1 and 2 were evaluated in photographic film units of the "peel-apart" type in the following manner.

A photosensitive element was utilized for the processing and evaluation of each of the image-receiving elements. The photosensitive element comprised a 4-mil (0.1 mm) opaque subcoated polyethylene terephthalate film base having the following layers coated thereon in succession:

1. a layer of sodium cellulose sulfate at a coverage of about 10 mg/m$^2$;

2. a cyan dye developer layer comprising about 900 mgs/m$^2$ of the cyan dye developer represented by the formula

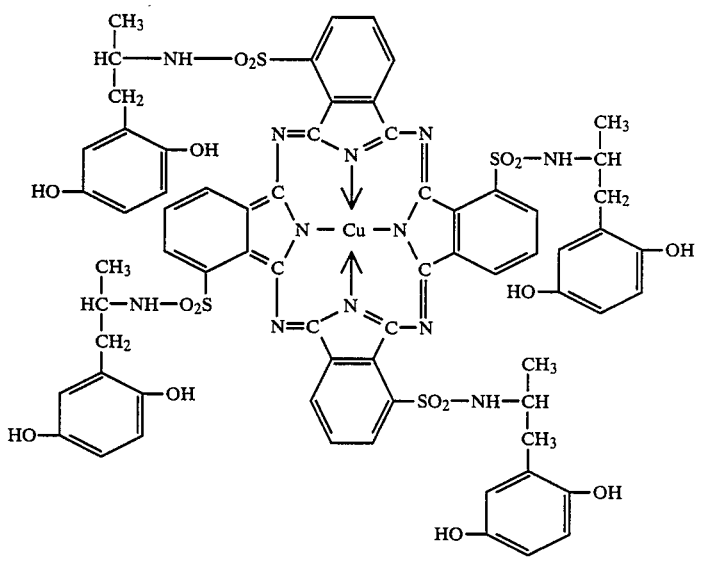

about 518 mgs/m$^2$ of gelatin; and about 135 mgs/m$^2$ of 4'-methylphenyl hydroquinone (MPHQ);

3. a red-sensitive silver iodobromide layer comprising about 1600 mgs/m$^2$ of silver (1.1 microns) and about 959 mgs/m$^2$ of gelatin;

4. an interlayer comprising about 2470 mgs/m$^2$ of a 61/29/6/4/0/4 pentapolymer of butylacrylate/diacetone acrylamide/methylacrylic acid/styrene/acrylic acid, about 130 mgs/m$^2$ of polymethylmethacrylate; and about 90 mgs/m$^2$ of dantoin hardening agent;

5. a magenta dye developer layer comprising about 450 mgs/m$^2$ of magenta dye developer represented by the formula

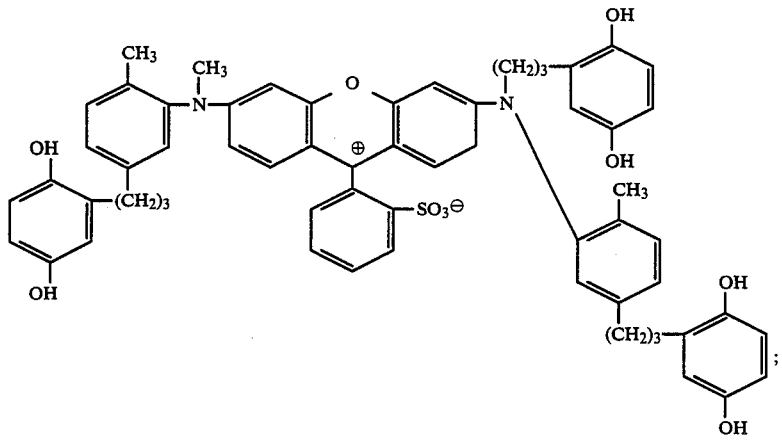

and about 225 mgs/m$^2$ of gelatin;

6. a green-sensitive silver halide emulsion layer comprising about 900 mgs/m$^2$ of silver (1.1 microns); about 525 mgs/m$^2$ of gelatin and about 150 mgs/m$^2$ of MPHQ;

7. an interlayer comprising about 2280 mgs/m$^2$ of the pentapolymer described in layer 4, about 120 mgs/m$^2$ of polyacrylamide; about 500 mgs/m$^2$ of scavenger represented by the formula

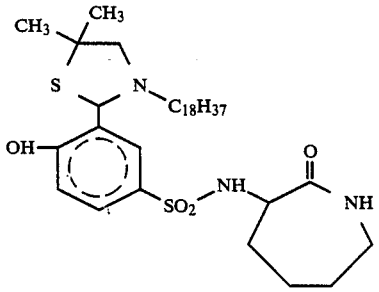

and about 20 mgs/m$^2$ of succindialdehyde;

8. a yellow filter layer comprising about 475 mgs/m$^2$ of benzidine yellow dye and about 238 mgs/m$^2$ of gelatin;

9. a yellow image dye-providing layer comprising about 1500 mgs/m$^2$ of a yellow image dye-providing material represented by the formula

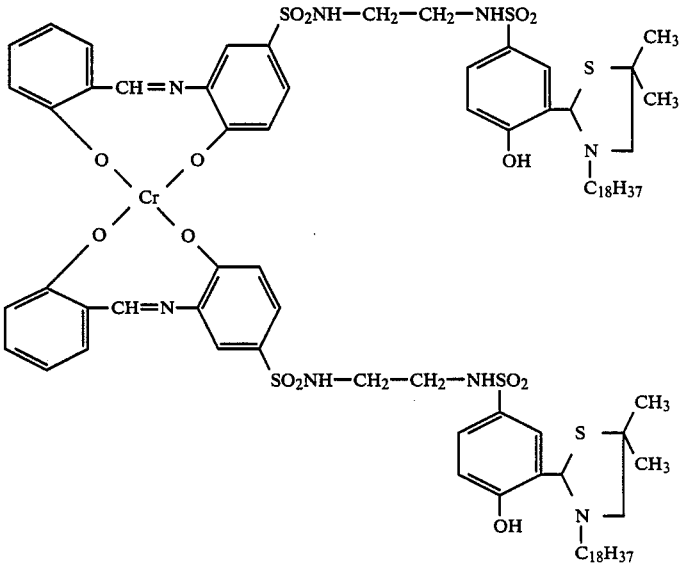

and about 750 mgs/m$^2$ of gelatin;

10. a layer comprising carboxylated styrenebutadiene latex (Dow 620 latex) coated at a coverage of 133 mgs/m$^2$ and about 67 mgs/m$^2$ of gelatin;

11. a blue-sensitive silver iodobromide layer comprising about 270 mgs/m$^2$ of silver (1.1 microns); about 500 mgs/m$^2$ of phenyl tertiary butyl hydroquinone; and about 385 mgs/m$^2$ of gelatin; and 12. an antiabrasion layer comprising gelatin coated at a coverage of about 300 mgs/m$^2$.

Film units were prepared utilizing each of Image-Receiving Elements A and A-Control and the photosensitive element aforedescribed. In each case, the image-receiving element and the photosensitive element were placed in a face-to-face relationship, i.e., with their respective supports outermost, and a rupturable container retaining an aqueous alkaline processing composition was affixed between the image-receiving and photosensitive elements at the leading edge of each film unit (such that the application of compressive pressure to the container would rupture the seal of the container along the marginal edge thereof and distribute the contents thereof uniformly between the photosensitive and image-receiving elements). The composition of the aqueous alkaline processing composition utilized for the processing of each film unit is set forth in the following TABLE I:

TABLE I

| Processing Composition | |
|---|---|
| Component | Amount in Parts by Weight |
| Hydroxyethyl cellulose | 3.4 |
| Potassium hydroxide | 9.4 |
| 1,2,4-triazole | 0.92 |
| Hypoxanthine | 1.41 |
| 6-methyluracil | 0.7 |
| 5-amino-1-pentanol | 0.25 |
| 3,5-dimethylimidazole | 0.45 |
| Titanium dioxide | 2.0 |
| 1-methylimidazole | 0.30 |
| 1-(4-hydroxyphenyl)-1H—tetrazole-5-thiol | 0.011 |
| N—pentyl-α-picolinium bromide | 2.5 |
| Water | Balance to 100 |

Each film unit was subjected to a standard sensitometric exposure and was processed at room temperature (about 20° C.) by spreading the processing composition between the elements as they were brought into superposed relationship between a pair of pressureapplying rollers having a gap of about 0.0038 inch. After an imbibition period of about 90 seconds, the image-receiving element was in each case separated from the remainder of the film unit to reveal the dye image. The image-bearing layer of each of the resulting photographs was evaluated immediately upon such separation for surface mobility, by a thumb test involving the application of thumb pressure in a shearing fashion, in an attempt to dislocate or smear the image-bearing layer.

In the case of the photograph prepared from Image-Receiving Element A, the application of thumb shear produced no apparent harmful effect, indicating that the image-bearing layer thereof was firmly adhered. In the case of the photograph prepared from Image-Receiving Element A-Control, application of thumb shear caused the image-bearing layer to slide away from the underlying layers, with the result that white pigment of the support layer was readily visible.

Each of the photographs was evaluated for minimum and maximum reflection densities (Dmin and Dmax, respectively) for red, green and blue, using a densitometer. Measurements were taken one-half hour after separation, and after three days under ambient room temperature conditions. The following values, reported in TABLE II, were obtained.

TABLE II

| Photograph From Image-Receiving Element | After Storage For | Dmin | | | Dmax | | |
|---|---|---|---|---|---|---|---|
| | | R | G | B | R | G | B |
| A | ½ hour | 0.08 | 0.11 | 0.15 | 1.27 | 1.56 | 1.77 |
| A | 3 days | 0.08 | 0.11 | 0.15 | 1.29 | 1.56 | 1.79 |
| A-Control | ½ hour | 0.10 | 0.18 | 0.21 | 1.76 | 1.78 | 2.29 |
| A-Control | 3 days | 0.10 | 0.18 | 0.21 | 1.44 | 1.50 | 1.68 |

As can be seen from inspection of the data presented in TABLE II, Dmax values decreased after three days in the case of the photograph prepared from Image-Receiving Element A Control, owing to the presence of salt species in the image-bearing layer thereof and the light-diffracting effect of such salt species in reducing reflectivity. Such results were visually confirmed—the photograph prepared from Image-Receiving Element A was substantially more glossy than the photograph prepared from Image-Receiving Element A-Control Each of the photographs was treated by application of a thin film of immersion oil over the image-bearing layer to increase gloss and eliminate refraction effects of any salt species that might be present. Dmin and Dmax values were measured, with the results reported in TABLE III as follows:

TABLE III

| Photograph From Image-Receiving Element, After Oiling | Dmin | | | Dmax | | |
|---|---|---|---|---|---|---|
| | R | G | B | R | G | B |
| A | 0.08 | 0.11 | 0.15 | 1.27 | 1.56 | 1.77 |
| A-Control | 0.10 | 0.18 | 0.21 | 1.76 | 1.78 | 2.29 |

As can be seen from inspection of the data presented in TABLE III, and comparison with the data in TABLE II, oil treatment of the image-bearing layer served to increase Dmax values in the case of the photograph prepared from Image-Receiving Element A-Control (indicating the effect of oil in overcoming the light-refracting effect of salt species in the image-bearing layer). No such improvement was observed in the case of the photograph prepared from Image-Receiving Element A (indicating the absence of light-refracting salt species in the image-bearing layer).

EXAMPLE 3

An image-receiving element especially adapted to utilization in photographic film units of the "peel-apart" type was prepared, the image-receiving element comprising a white-pigmented polyethylene-coated paper (opaque) support carrying the following layers in succession:

1. a polymeric acid-reacting layer, at a coverage of about 1700 mgs/ft$^2$ (18299 mgs/m$^2$) of a mixture of about 1.5 parts polyvinyl alcohol and one part poly(-methylvinylether-co-maleic anhydride), and about 170 mgs/ft$^2$ (1830 mgs/m$^2$) of acrylic latex crosslinking agent;

2. a layer of about 450 mgs/ft$^2$ (4844 mgs/m$^2$) of polyacrylamide and about 45 mgs/ft$^2$ (484 mgs/m$^2$) of pentaerythritol-tris-(β-(aziridinyl) propionate;

3. a timing layer, at a coverage of about 630 mgs/ft$^2$ (6782 mgs/m$^2$), coated from a latex and comprising a 50/30/6/10/4 copolymer of diacetone acrylamide/butyl acrylate/methyl methyacrylate/carbomethoxymethyl acrylate/methacrylic acid;

4. an image-receiving layer, at a coverage of about 300 mgs/ft$^2$ (3229 mgs/m$^2$) of a graft copolymer comprising 4-vinylpyridine (4VP) and vinylbenzyl trimethylammonium chloride (TMQ) grafted onto hydroxyethyl cellulose (HEC) at a ratio of HEC/4VP/TMQ of 2.2/2.2/1, including a minor amount of acetic acid to adjust the coated layer to pH 4, a minor amount of tint dye, and about 12 mgs/ft$^2$ (129 mgs/m$^2$) of pentaerythritol-tris-(β-(aziridinyl) propionate; and 5. an overcoat layer, at a coverage of about 50 mgs/ft$^2$ (538 mgs/m$^2$), of a mixture of about two parts gum arabic and one part ammonium hydroxide.

Such image-receiving element when processed with a photosensitive element and in the manner as described in EXAMPLE 2 provides similar results, in that, a photograph having good densitometry, high gloss and absence of salts from the image-bearing layer is obtained.

What is claimed is:

1. An image-receiving element for photographic diffusion transfer processing comprising in order:

a support layer;

a polymeric acid-reacting layer;

a water-permeable and water-absorbing polymeric layer, said layer being effective to absorb water introduced into said image-receiving element during said diffusion transfer processing;

a water-impermeable polymeric timing layer through wich aqueous alkali must pass to said polymeric acid-reacting layer, said polymeric timing layer being deposited from a polymeric latex and being essentially non-absorbing of water and being substantially impermeable for a predetermined time interval to the passage of aqueous alkali therethrough, said polymeric timing layer including a polymer comprising polymerized repeating units, which as a function of contact with aqueous alkaline processing composition and after said predetermined time interval, undergo an alkali-initiated chemical reaction effective to convert said timing layer from a condition of substantial impermeability to the passage of aqueous alkali to a condition of substantial permeability thereto; and a water-permeable and dyeable image-receiving layer.

2. The image-receiving element of claim 1 wherein said support layer comprises an opaque support layer.

3. The image-receiving element of claim 1 wherein said water-permeable, water-absorbing polymeric layer comprises a polymeric material selected from the group consisting of hardened gelatin, polyvinyl alcohol, hydroxyethyl cellulose, hydroxypropyl cellulose, polyacrylamide and mixtures thereof.

4. The image-receiving element of claim 1 wherein said water-permeable, water-absorbing polymeric layer comprises a layer of hardened gelatin.

5. The image-receiving element of claim 1 wherein said water-permeable, water-absorbing polymeric layer comprises a layer of polyacrylamide.

6. The image-receiving element of claim 1 wherein said alkali-initiated chemical reaction effective to convert said timing layer from a condition of substantial impermeability to the passage of aqueous alkali to a condition of substantial permeability thereto is an alkali-initiated beta-elimination reaction.

7. The image-receiving element of claim 6 wherein said timing layer comprises a polymer having polymerized repeated units of the formula

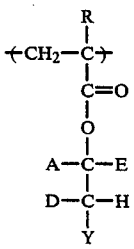

wherein R is hydrogen or lower alkyl; A, D and E are each selected from the group consisting of hydrogen, methyl and phenyl, provided that no more than one of A, D and E is methyl or phenyl; and Y is an activating group for said beta-elimination reaction.

8. The image-receiving element of claim 1 wherein said alkali-initiated chemical reaction effective to convert said timing layer from a condition of substantial impermeability to the passage of aqueous alkali to a condition of substantial permeability thereto is an alkali-initiated hydrolysis reaction.

9. The image-receiving element of claim 8 wherein said timing layer comprises a polymeric having polymerized repeating units of the formulas (II) and/or (III)

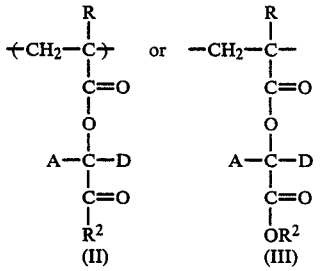

wherein R is hydrogen or lower alkyl; A and D are each hydrogen, methyl or phenyl; and $R^2$ is alkyl.

10. The image-receiving element of claim 8 wherein said timing layer comprises a polymer having polymerized repeating units of the formula

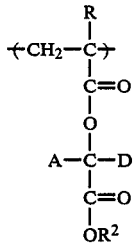

wherein R is hydrogen or methyl; each of A and D is hydrogen; and $R^2$ is methyl or ethyl.

11. The image-receiving element of claim 10 wherein said polymeric acid-reacting layer comprises a mixture of a half butyl ester of polyethylene/malic anhydride copolymer and polyvinyl butyral 12. The image-receiving element of claim 10 wherein said polymeric acid-reacting layer comprises a mixture of a water-soluble polymeric acid and a water-soluble matrix or binder material therefor.

13. The image-receiving element of claim 12 wherein said polymeric acid-reacting layer comprises a mixture of poly (methyl vinyl ether/maleic anhydride) and polyvinyl alcohol.

14. The image-receiving element of claim 1 wherein said water-permeable and dyeable image-receiving layer comprises a mixture of polyvinyl alcohol and a mordant for dye-image forming material.

15. The image-receiving element of claim 1 wherein said water-permeable and dyeable image-receiving layer comprises a graft copolymer of 4-vinylpyridine and vinylbenzyltrimethyl-ammonium chloride grafted onto hydroxyethyl cellulose.

16. The image-receiving element of claim 1 wherein over said water-permeable and dyeable image-receiving layer is a polymeric overcoat layer.

17. The image-receiving element of claim 16 wherein said overcoat layer comprises a layer of poxyoxyethylene polyoxypropylene block copolymer.

* * * * *